US005564807A

United States Patent [19]

Röck et al.

[11] Patent Number: 5,564,807

[45] Date of Patent: Oct. 15, 1996

[54] PULL-OUT MECHANISM FOR DRAWERS

[75] Inventors: Erich Röck; Ingo Gasser, both of Höchst, Austria

[73] Assignee: Julius Blum Gesellschaft m.b.H, Höchst, Austria

[21] Appl. No.: 372,373

[22] Filed: Jan. 13, 1995

[30] Foreign Application Priority Data

Jan. 17, 1994 [AT] Austria ..... 75/94

[51] Int. Cl.[6] ..... A47B 88/08

[52] U.S. Cl. ..... 312/331; 312/334.6; 312/334.12

[58] Field of Search ..... 312/334.6, 334.8, 312/334.12, 334.13, 334.32, 334.9, 334.15, 334.33, 331, 334.1, 348.1, 348.2, 348.4; 384/19, 18, 22

[56] References Cited

U.S. PATENT DOCUMENTS

| | | | |
|---|---|---|---|
| 2,267,043 | 12/1941 | Premo | 312/331 X |
| 3,078,129 | 2/1963 | Beeck | 384/19 |
| 3,545,833 | 12/1970 | Stein et al. | 312/334.9 |
| 3,687,505 | 8/1972 | Fall et al. | 384/18 |
| 3,722,964 | 3/1973 | Chitester et al. | 384/18 |
| 3,980,364 | 9/1976 | Entrikin et al. . | |
| 4,025,138 | 5/1977 | Kittle . | |
| 4,199,200 | 4/1980 | Livingston et al. . | |
| 4,627,760 | 12/1986 | Yagi et al. . | |
| 5,275,064 | 1/1994 | Hobbs | 312/334.1 X |
| 5,421,648 | 6/1995 | Grabher | 312/334.13 X |
| 5,458,413 | 10/1995 | Huber et al. | 312/348.4 |
| 5,492,400 | 2/1996 | Röck | 312/331 |

FOREIGN PATENT DOCUMENTS

| | | | |
|---|---|---|---|
| 63-5226 | 1/1995 | European Pat. Off. | 312/334.1 |
| 2844850 | 4/1980 | Germany . | |
| 2904116 | 8/1980 | Germany . | |
| 3335700 | 4/1985 | Germany . | |
| 9115465.0 | 4/1992 | Germany . | |
| 660633 | 11/1951 | United Kingdom . | |

*Primary Examiner*—Peter M. Cuomo
*Assistant Examiner*—Janet M. Wilkens
*Attorney, Agent, or Firm*—Wenderoth, Lind & Ponack

[57] ABSTRACT

A pull-out mechanism for a drawer includes a support rail which is to be secured to a furniture cabinet, a pull-out rail which is to be secured to the drawer and a central rail arranged between the support and pull-out rails. The weight of the drawer is transmitted between the rails by rollers. Respective deflection rollers are arranged at the front and rear ends of the central rail. A control cable is secured to the support rail and to the pull-out rail and is guided over the deflection rollers. The cable has two free ends which are each connected to a coupling including a receiving part and an inserting part, each of which has a respective retaining member in the shape of a toothed rack, by way of which the inserting part can be coupled in the receiving part over a capture region corresponding to the length of the toothed racks. One of the coupling parts can be coupled to the support or pull-out rail.

23 Claims, 12 Drawing Sheets

PULL-OUT MECHANISM FOR DRAWERS

FIELD AND BACKGROUND OF THE INVENTION

The invention relates to a pull-out mechanism for use on each side of a drawer or the like and including a support rail which is to be secured to a furniture cabinet, a pull-out rail which is to be secured to the drawer and a central rail arranged between the support and pull-out rails, the weight of the drawer being transmitted between the rails by rollers or the like. Respective deflection rollers are arranged at front and rear ends of the central rail. A control cable is secured to the support rail and to the pull-out rail and is guided over the deflection rollers.

Various pull-out mechanisms for drawers are known, wherein a drawer can be pulled entirely out of a furniture cabinet and is still held by the rails of the pull-out mechanism. In the case of some pull-out mechanisms, a device is provided which is intended to ensure that the rails run differentially with respect to one another. Such device can, for example, include a toothed wheel which is mounted on the central rail and meshes with toothed racks on the pull-out rail and the support rail. A simplified construction would be the arrangement of a frictional wheel on the central rail.

A particularly precise guidance of the central rail is achieved using a control cable which is secured to the support rail and the pull-out rail and which runs on both sides of the central rail and is guided at front and rear ends over belt guides of the central rail. A pull-out mechanism of this type is described in DE-A1-29 04 116. A similar pull-out mechanism in which a control cable is guided over rollers is known from U.S. Pat. No. 4,025,138.

SUMMARY OF THE INVENTION

It is an object of the invention to provide a pull-out mechanism having a control cable-type control in which a pull-out rail easily can be removed from a central rail.

It is a further object of the invention to provide that the control cable can be tensioned.

These objects according to the invention are achieved in that a cable has two free ends connected to respective coupling parts. One coupling part is a receiving part and the other is an inserting part. Both parts have profiles in the shape of toothed racks, by way of which the inserting part can be coupled into the coupling part over a capture region corresponding to the length of the toothed racks. One of the coupling parts can be coupled to the support rail or pull-out rail.

So that the closed drawer is always pulled entirely into the furniture cabinet, in one embodiment of the invention a retraction means, arranged on the support rail or on the pull-out rail, includes a spring-loaded entrainer which can travel along a liner guidance path longitudinally of the rails and can be locked at the two ends of the guidance path. The central rail has a peg or the like on which the entrainer acts in the rear retraction region, thus pulling the central rail into a fully inserted position thereof.

So that the front panel is always pushed snugly against the side walls of the furniture cabinet, the pull-out rail has to be positioned precisely in relation to the control cable. In one embodiment of the invention, this is achieved by provision of two further coupling parts which can be coupled to one another by way of profiles in the shape of toothed racks. One such part is an inserting part and is secured to a control part, e.g. the cable. The other such part is a receiving part and is secured to the pull-out rail or the support rail, preferably the pull-out rail. Such receiving part has a trough-shaped recess into which the inserting part can be pushed. As a result, the drawer can be placed onto the control cable and coupled using the pull-out rail, whereupon the drawer can be pulled as far as a stop relative to the control cable.

BRIEF DESCRIPTION OF THE DRAWINGS

An embodiment of the invention will be described in detail below with reference to the accompanying drawings, wherein.

DESCRIPTION OF THE PREFERRED EMBODIMENTS

A drawer is formed by two metal drawer side frames 28, a front panel 39, a drawer bottom plate 38 and the rear wall 27.

Figure 1:
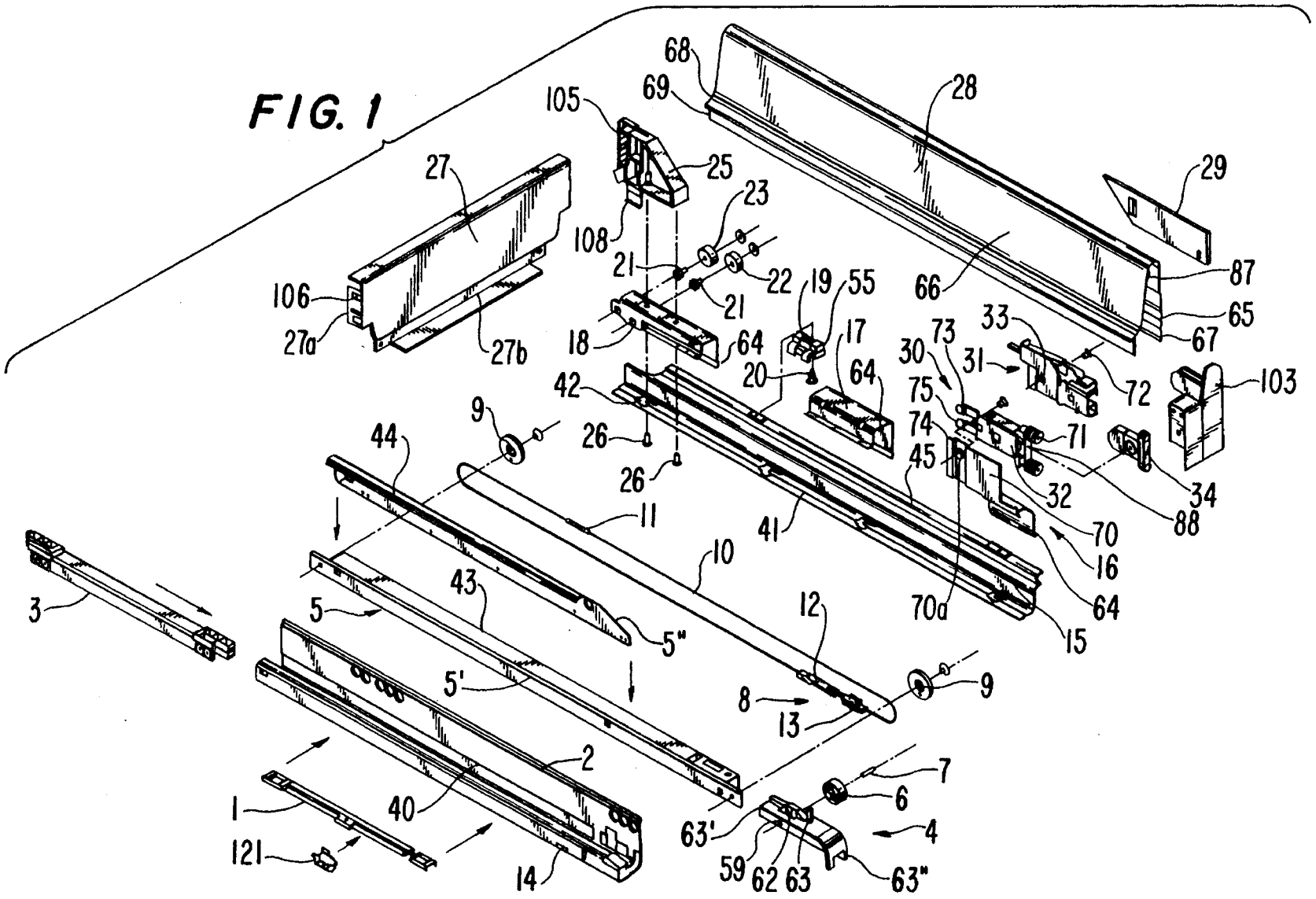
FIG. 1 is a perspective exploded view of parts of a pull-out mechanism and a drawer frame.
Figure 2:
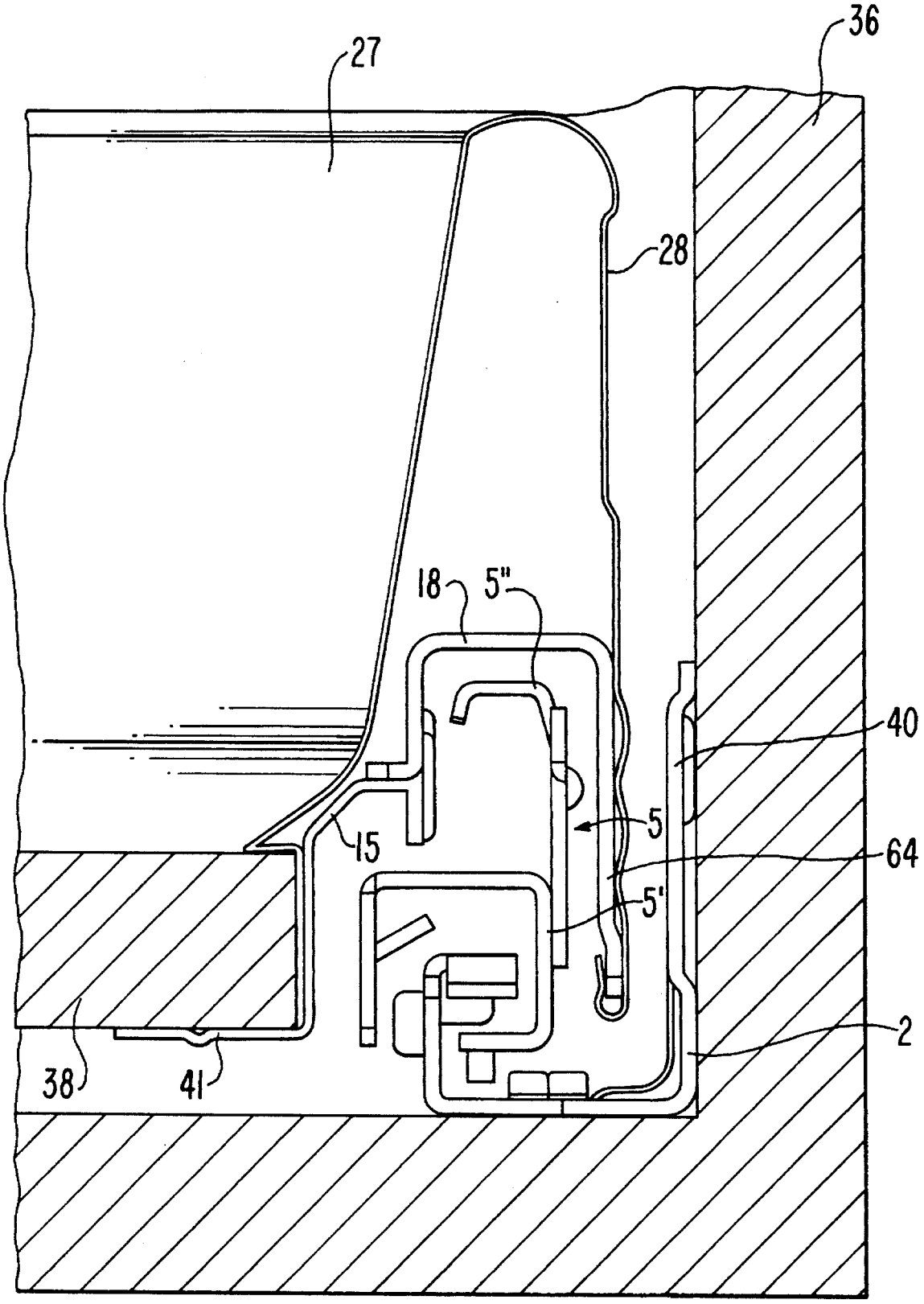
FIG. 2 is a vertical section through one side of the drawer.
Figure 3:
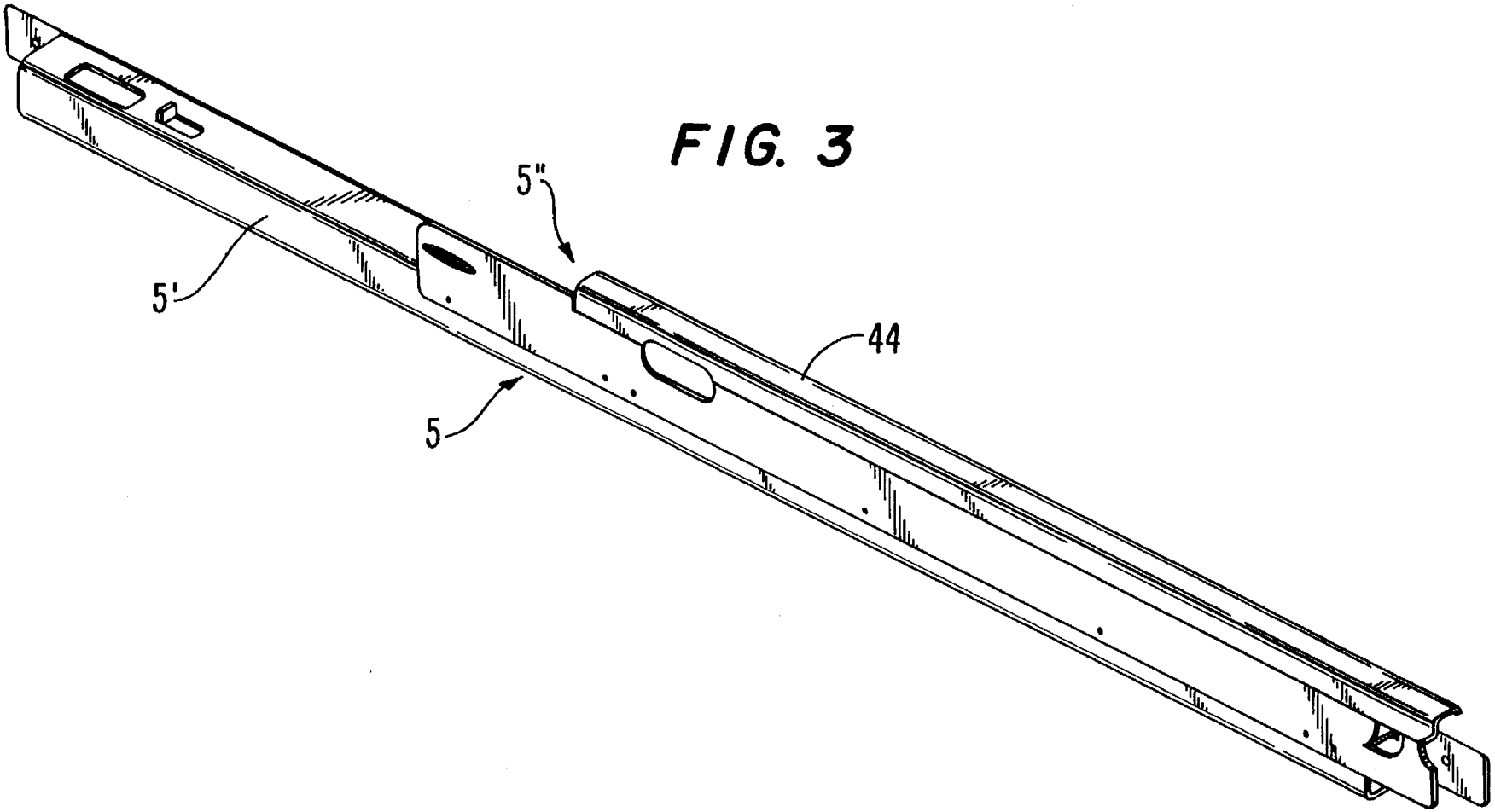
FIG. 3 is a perspective view of a central rail.
Figure 4:
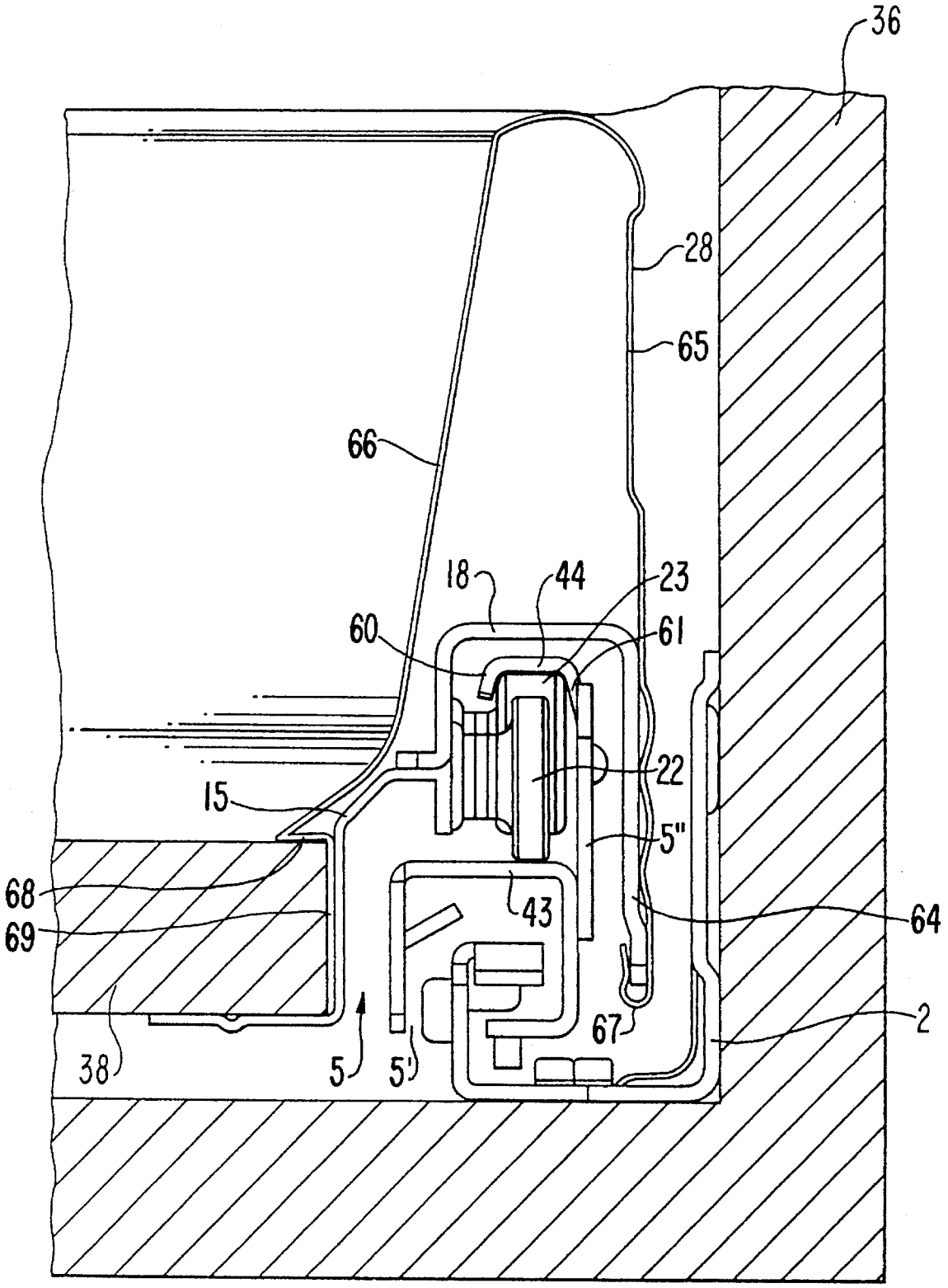
FIG. 4 is a vertical section through a rear portion of the drawer frame and the pull-out mechanism.
Figure 5:
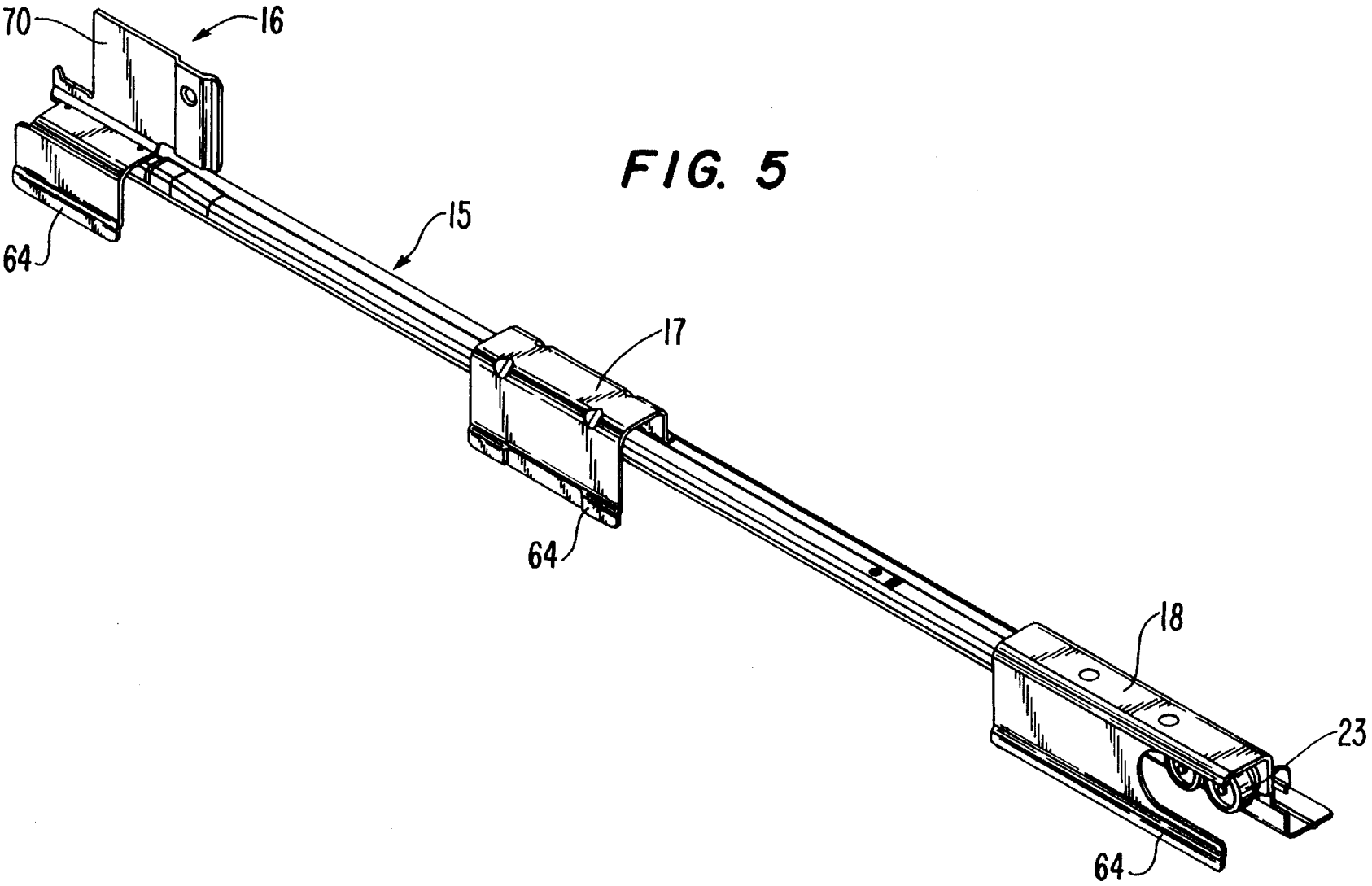
FIG. 5 is a perspective view of a pull-out rail with an adapter.
Figure 6:
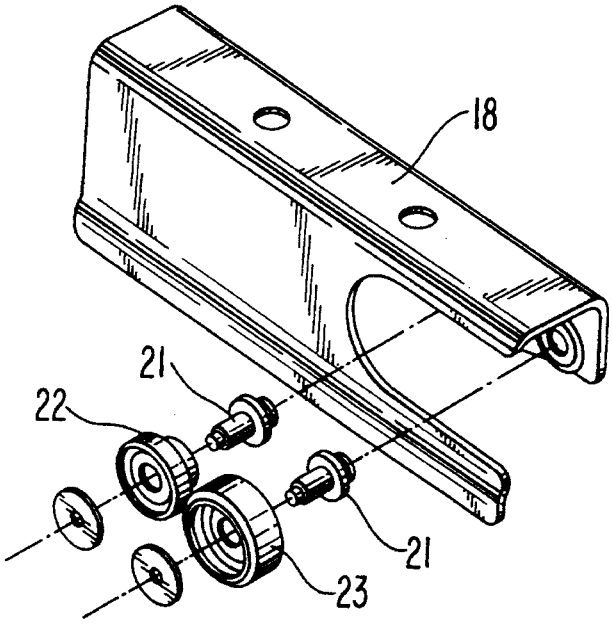
FIG. 6 is a perspective exploded view of rear running rollers and a rear adapter.

Within the drawer frame 28 there are three adapters 16, 17, 18 which are secured to a pull-out rail 15, for example welded thereto. A support rail 2 is secured to a cabinet side wall 36 in conventional manner by way of a securing web 40. The drawer bottom plate 38 lies on a horizontal web 41 of a pull-out rail 15. In the horizontal web 41 are tabs 42 which can be pushed from the horizontal web 41 and have barbed configurations so that they can be pushed into a groove or the like in the drawer bottom plate 38 and thus anchor the drawer bottom plate 38 on the pull-out rail 15. A central rail 5 is positioned between the pull-out rail 15 and the support rail 2. The central rail 5 has a lower profile or portion 5' in which there is a carriage 3 (FIG. 1) to which rollers are mounted. Thus, the central rail 5 is guided relative to the support rail 2 by way of the rollers mounted in the carriage 3. Furthermore, the central rail 5 is provided with an upper, partially U-shaped profile or portion 5". Rollers 22, 23 are mounted on rear adapter 18 of the pull-out rail 15 and run on webs 43, 44 of center rail 5 (FIG. 4). Web 45 of pull-out rail 15 runs on a roller 6 (FIG. 1) which is mounted on the lower profile 5' of the central rail 5.

Figure 8:
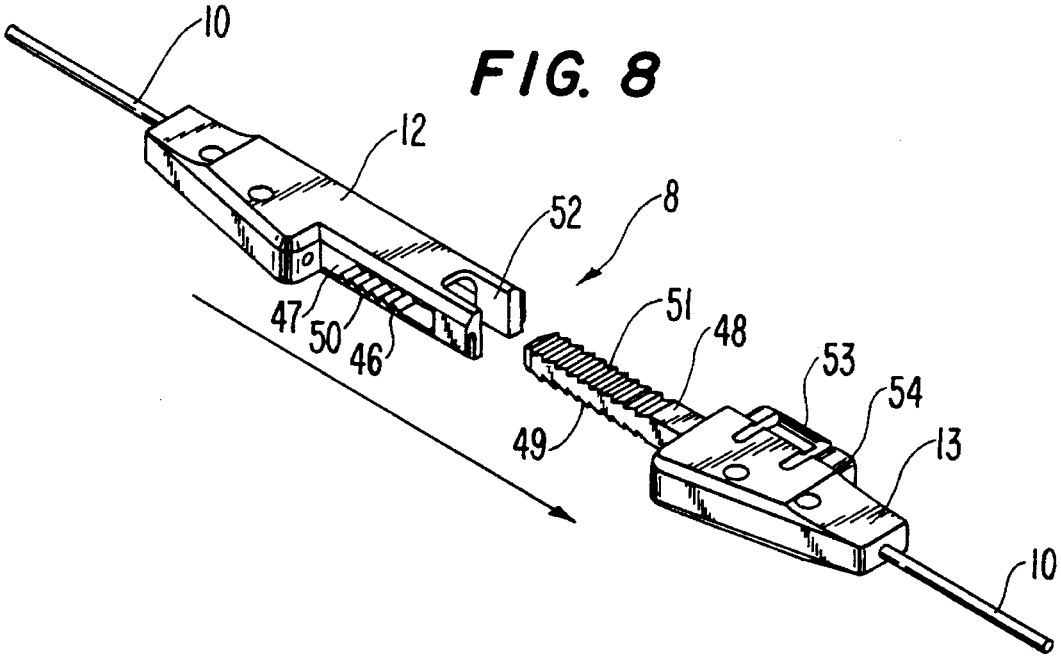
FIG. 8 is an enlarged perspective view of the cable coupling.
Figure 7:
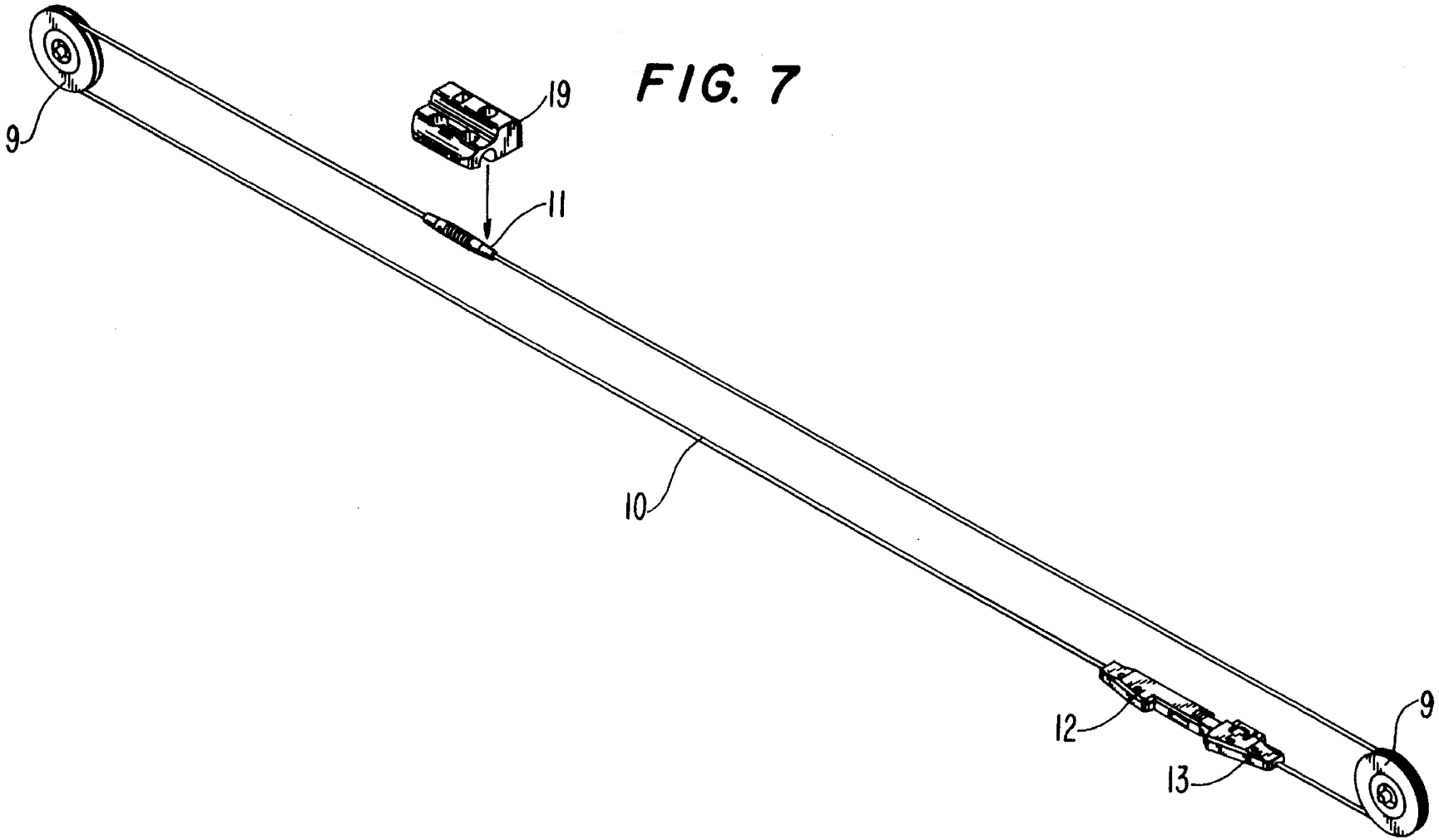
FIG. 7 is a perspective view of a control cable and two couplings.

The central rail 5 has thereon front and rear cable rollers 9, and a control cable 10 is mounted to run on cable rollers 9. The control cable 10 which is formed for example from a wire or synthetic cable, has a catch-type cable coupling device 3 (FIG. 1) including two coupling parts or portions 12, 13 which are connected to ends of the control cable 10 (FIGS. 7, 8). In this case the coupling part 12 is constructed as a female part or a housing having two interior retaining members or profiles 46 in the shape of racks formed by teeth 50. Side walls are provided with apertures 47 which provide the housing of the coupling part 12 with a certain elasticity. The coupling part 13 has a web or projection 48 which is provided with retaining members or profiles 49 in the shape of racks formed by teeth 51 of a shape complementary to the profiles 46 of the coupling part 12. The web 48 can be pushed into the housing of the coupling part 12 far enough for the control cable 10 to be tensioned. The teeth 50, 51 of the profiles 46, 49 are in the shape of barbs inclined to face towards one another in order to facilitate pushing the web 48 of the coupling part 13 into the housing of the coupling part 12. At its end facing the coupling part 13, the coupling part 12 is provided with a U-shaped recess 51. The coupling part 13 has a lateral hook 53, by means of which it can be inserted into an opening 14 (FIG. 1) in the support rail 2. Thus, the coupling part 13 can be anchored to the support rail 2 by way of the hook 53. On both sides of the hook 53 are guide pegs 54 that also project into the opening 14 and improve the sealing of the hook 53 in the opening 14.

In order to connect the control cable 10 to the pull-out rail 15, a further coupling is provided. Such coupling includes an outer coupling part 19 and an inner coupling part 11. The outer coupling part 19 is secured to the pull-out rail 15 by means of screws or rivets 20 (FIG. 1) which project through securing holes. Outer coupling part 19 surrounds the inner coupling part 11. The inner coupling part 11 is torpedo-shaped and can be pushed into a trough-shaped recess 55 in the outer coupling part 19. A slot-type aperture 120 having opposite ends which widen into circles is provided in outer coupling part 19. This increases the elasticity of the coupling part 19, which is made from synthetic material. On interior walls of the trough-shaped recess 55 are two retaining members or profiles in the shape of racks formed by teeth which are complementary to a retaining member or profile 56 in the shape of a rack formed by teeth 57 of the inner coupling part 11. The teeth 57 of the profile 56 are constructed to be annular. The cross-section of the teeth 57 are barbed or inclined in the shapes of isosceles triangles. Outer edges of the teeth 57 can be rounded. The coupling part 11 is, as can be seen from FIGS. 9, 10, constructed to be approximately cylindrical or torpedo-shaped and has at opposite ends thereof frustoconical end portions 58.

Figure 9:
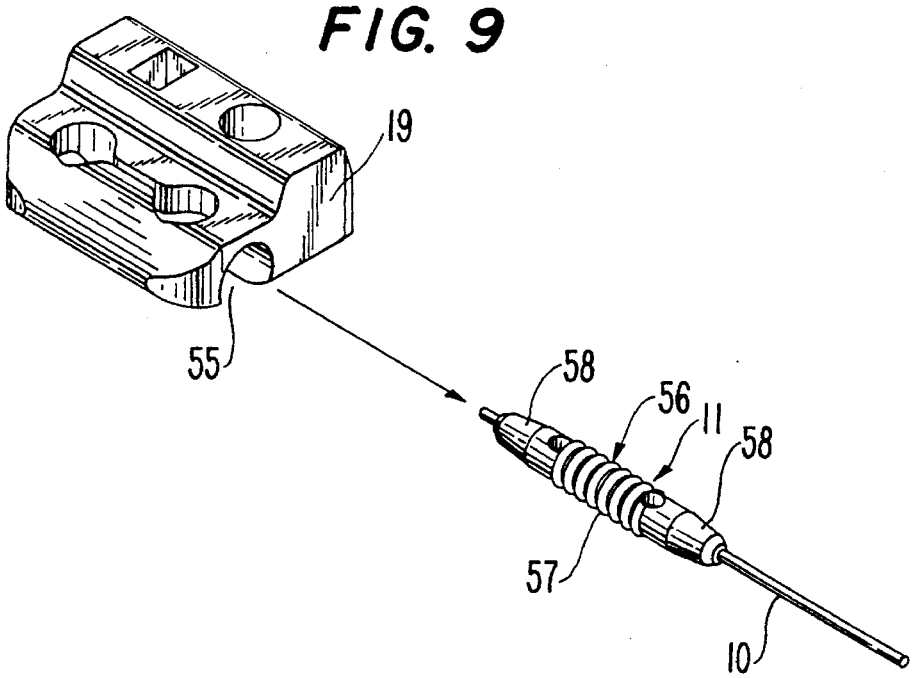
FIG. 9 is an enlarged perspective view of the coupling which connects the control cable to the pull-out rail, such coupling being shown from the front.
Figure 10:
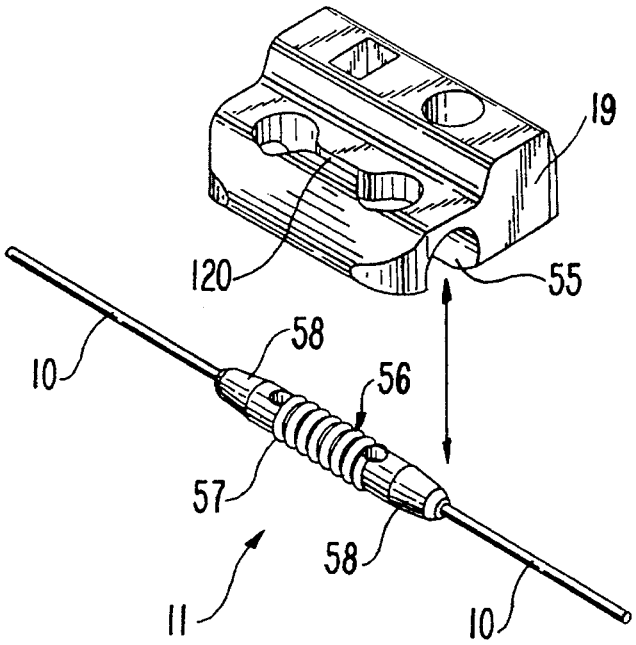
FIG. 10 is a view similar to FIG. 9, and illustrating that coupling of the coupling part of the pull-out rail is from above.
Figure 11:
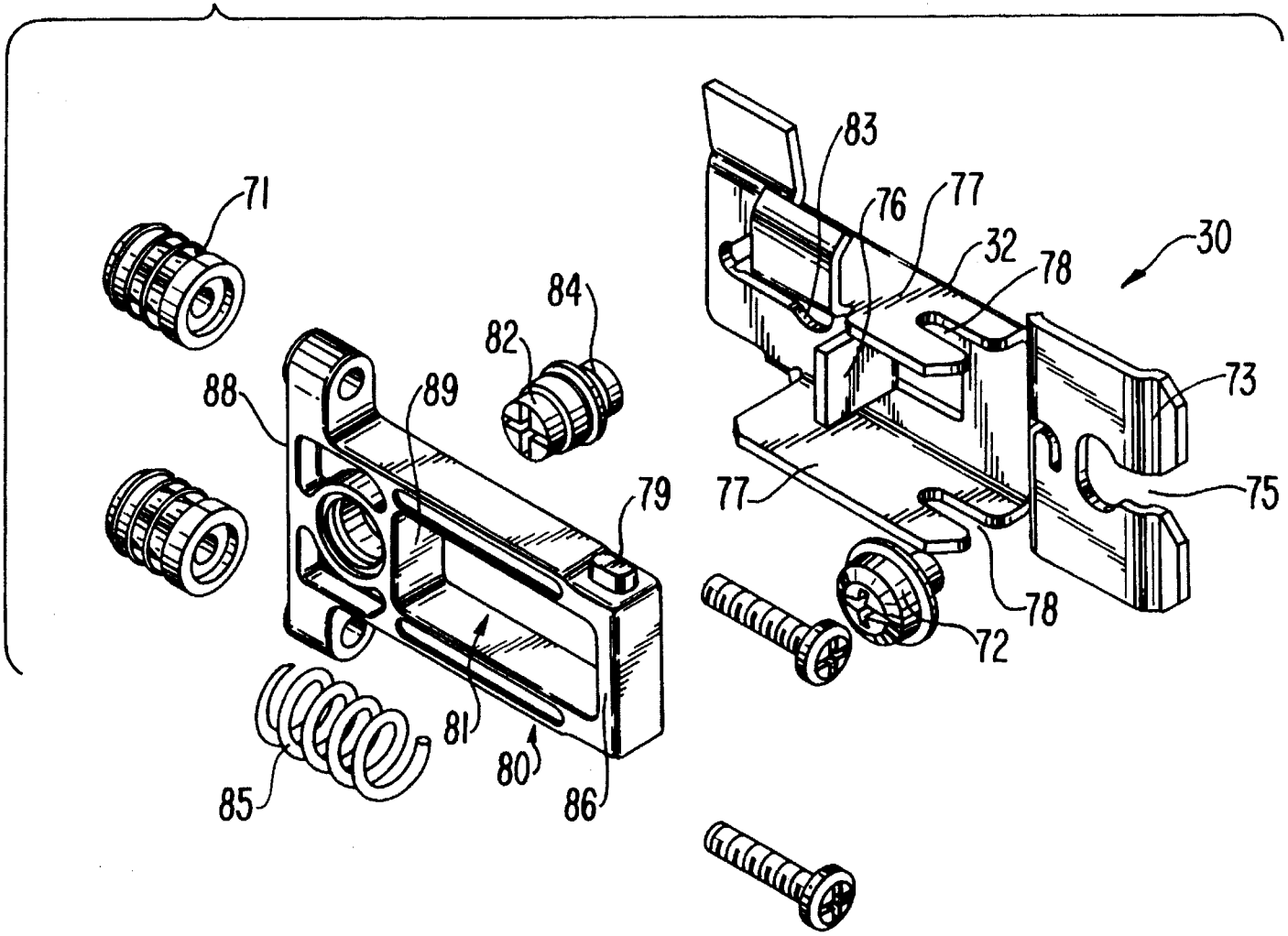
FIG. 11 is a perspective exploded view of means for securing a front panel.
Figure 12:
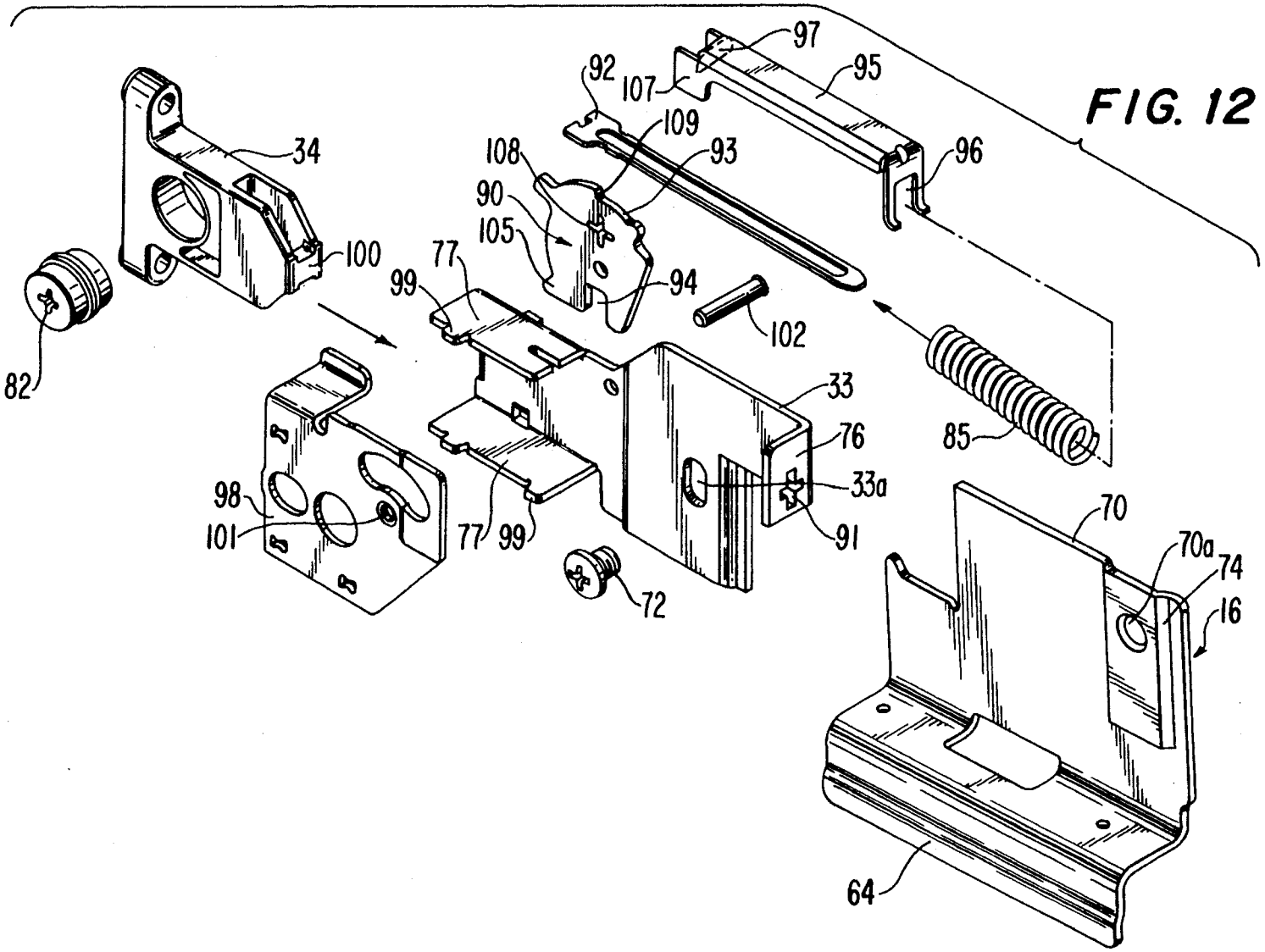
FIG. 12 is a view similar to FIG. 11, but of a further embodiment of a front panel securing means.

In order to connect the coupling parts 11, 19 to one another, as shown in FIG. 9 the coupling part 19 can be pushed onto the coupling part 1 from the front or axially, or as shown in FIG. 10 it can be pushed onto the coupling part 11 from above. In order to position the coupling part 19 in relation to the coupling part 1 precisely enough for the front panel 39 to be pushed snugly against side walls 36 of the furniture cabinet by a retraction means 1, the drawer can be pulled forwardly with the pull-out rail 15 and the coupling part 19 relative to the coupling part 11 until engagement between the two coupling parts 11, 19 prevents further relative movement. On taking the drawer out of the furniture cabinet, the drawer is lifted up and the coupling part 19 is lifted upwardly away from the coupling part 11. Retraction means i includes a spring-loaded retainer and is mounted on either the support rail 2 or the pull-out rail 15. Central rail 5 has a peg or similar member 121 against which the retainer acts. The retainer is movable longitudinally of the rails and can be locked at two ends of the path of such movement. The entrainer is operable to pull central rail 5 into a fully inserted position thereof.

At the front end of the lower profile 5' of the central rail 5, running roller 6 is mounted on tabs 59 by means of a rivet 7. The running web 45 of the pull-out rail 15 runs on the running roller 6. Adapters 16, 17, 18 are secured to the pull-out rail 15. Rollers 22, 23 are mounted on the rearmost adapter 18 by means of rivets 21. Rollers 22, 23 are guided in the upper profile 5" of the central rail 5 and are located in the interior of the adapter 18 one behind the other. Front roller 22 is narrower than the rear roller 23 and, when the drawer is moved, is support against the web 43 of the central rail 5. The web 44 of the profile 5" of the central rail 5 is constructed to be U-shaped, with a lateral delimiting web 60. Between delimiting web 60 and a vertical web 61 which inclines upwardly at the same angle as delimiting web 60, is snugly guided the roller 23. As a result, lateral guidance of the pull-out rail 15 and thus of the drawer is ensured. Since the roller 22 is supported against the lower horizontal web 43 and the roller 23 is supported against the upper horizontal web 44, when the drawer is pulled out or pushed in there is no change n the direction of rotation of the running rollers 22, 23 and thus smooth running of the drawer is achieved.

At the front end of the lower profile 5' of the central rail 5 is secured a ramp block 4 of synthetic material. The ramp block 4 has an opening 62 in which the roller 6 is mounted. The roller 6 is mounted on rivet 7 which is held in flanges 67. The ramp block 4 extends over the front end of the lower profile 5' of the central rail 5 and includes a rail web 63 which has a straight portion 63' and a front, downwardly bent portion 63". When the drawer is suspended in place, the pull-out rails 15 are guided on the rail web 63 by way of their running webs 45, as a result of which suspension in place of the drawer is substantially facilitated.

All three adapters 16, 17, 18 have downwardly projecting holding webs 64. Each drawer frame 28 is constructed to be double-walled with an outer wall 65 and an inner wall 66. The outer wall 65 has, at its lower edge, a holding web 67 which is angled inwardly and upwardly in the manner of a hook and by means of which it can be suspended in place on the holding webs 64 of the adapters 16, 17, 18. The inner wall 66 has a horizontal web 68 which lies on the drawer bottom plate 38 when the drawer is mounted, and a vertical lateral web 69 which bears laterally against the drawer bottom plate 38. The transition from the horizontal web 68 to the inner wall 66 is rounded off.

Because the drawer frame 28 is welded or connected by tongue-and-groove connections neither to the adapters 16, 17, 18 nor to the pull-out rail 15, drawer frames of any material can be suspended in place on the adapters 16, 17, 18, from synthetic frames or aluminum frames to steel frames of a Nirosta material. The furniture manufacturer thus has the possibility of equipping even those drawers which are very different in price with the differential pull-out mechanism according to the invention.

The frontmost adapter 16 is provided with a holding plate 70 onto which a support part 32, 33 of a securing means 30, 31 for securing the front panel 39 can be screwed. Using securing means 30, the front panel 39 is pressed onto dowels 71 of a holding part 80, and support part 32 is secured to holding plate 70 by a screw 72, thus mounting the securing means 30 in its entirety on the pull-out rail 15. Using securing means 31, a holding part 34 is secured to the front panel 39 and the support part 33 is secured to the holding plate 70 by screw 72. Both the support part 33 of the securing means 31 and the support part 32 of the securing means 30 are provided with a lateral guide wall 73 which bears against a corresponding guide wall 74 of the holding plate 70.

Support part 32 of the securing means 30 has a rearwardly open slot 75 through which projects securing screw 72 which can be screwed into a female thread 70*a* in the holding plate 70. The securing means 30 has a holding part 80 which is secured to the front panel 39 by means of dowels 71. The support part 32, which is punched out of a steel sheet, has a tab or flange 76 which projects at a right angle from the support part 32. Support part 32 has top and bottom horizontal webs 77, each having a rearwardly open slot 78. Pegs 79 of the holding part 80 are guided in the slots 78. The holding part 80 is provided with a cutout 81. Furthermore mounted in the holding part 80 is an adjusting screw 82 for lateral adjustment of the front panel 39. When the fitting is mounted, an upper edge 83 of the support part 32 projects into an annular groove 84 in the adjusting screw 82, with the result that by turning the adjusting screw 82 the holding part 81 is moved laterally with respect to the support part 32. When the securing means 30 is mounted, the flange 76 of the support part 32 projects into the cutout 81 in the holding part 80. A pressure spring 85 is mounted in the cutout 81 and is supported at one end against a web 86 of the holding part 80 and at the other end against the tab 76 of the support part 32. As a result of the pressure spring 85, the holding part 80 is pushed rearwardly and thus the front panel 39 is tightened against the end edges of the drawer frames 28.

If the drawer is pushed into the furniture cabinet too vigorously, the front panel 39 strikes against the end edges of the side walls 36 of the furniture cabinet. However, the drawer can, with the drawer frames 28, the pull-out rails 15 and the support parts 32, move further in opposition to the pressure of the pressure springs 85 relative to the holding parts 80, with the result that a damping effect occurs and the seating of the dowels 71 in the front panel 39 is not over-stressed. Once the energy of inward movement is consumed, the drawer frames 28 are pushed, by way of the support part 32 and the holding plates 70, against the front panel 39 by the pressure springs 85.

When the drawer is assembled, the securing means 30 according to the invention is mounted in its entirety in the drawer frame 28. The holding part 80 is pushed to a rear end position by the pressure spring 85. The outer wall 65 of the front panel 28 is provided in the region of the securing means 30, 33 with a cutout 87 which enables access of tools to the securing means 30, 33. The cutout 87 is covered by a removable cover plate 29.

To mount the front panel 39, the holding part 80 is pushed somewhat outwardly of the drawer frame 28 by means of a pressure ram which engages in the cutout 81 and bears against a web 89 of the holding part 80, with the stop face 88 lying just in front of the end face of the drawer frame 28. In this position, the front panel 39 can be pressed against the dowels 71 of the holding part 80. Once the front panel 39 is anchored on the dowels 71 of the holding part 80, the pressure ram is withdrawn from the cutout 81 and the pressuring spring 85 pushes the holding part 80 into the drawer frame 28 to such an extent that the front panel 29 bears snugly against the end face of the drawer frame 28.

The securing means 31 has support part 33 which is secured to the holding plate 70 of the adapter 16 by screw 72. A tilt lever 90 is moved on the support part 33. At the rear, the support part 33 has a bent tab 76 against which the spring 85 is supported. The bent tab 76 is provided with a cross slot 91 through which there projects a rod 92 which supports the spring 85 and directly acts on the tilt lever 90. The support part 33 is secured by means of the screw 72, which projects through a vertical elongate hole 33*a* in the support part 32 and can be screwed into the holding plate 70. The tilt lever 90 has an upper notch 93 and a lower notch 94. Above the tilt lever 90 is locking bolt 95 which at its rear end is mounted on rod 92 by means of a punched-out slot 96 and which has a front locking web 97 which latches into the notch 93 on the tilt lever 90 when the front panel 39 is secured. The holding part 34 is secured directly to the front panel 39 and has mounted therein adjusting screw 82 for lateral adjustment. The support part 32 has upper and lower horizontal webs 77 defining therebetween a space into which the holding part 34 can be pushed. A lateral plate 98 is pushed onto the webs 77 and pegs 99 of the webs 77 project into openings in page 98. The support part 33 and the lateral plate 98 have punched holes 101 through which projects a pin 102 which forms an axle of the tilt lever 90. The holding part 34 is provided with a lug or hook 100.

Figure 13:
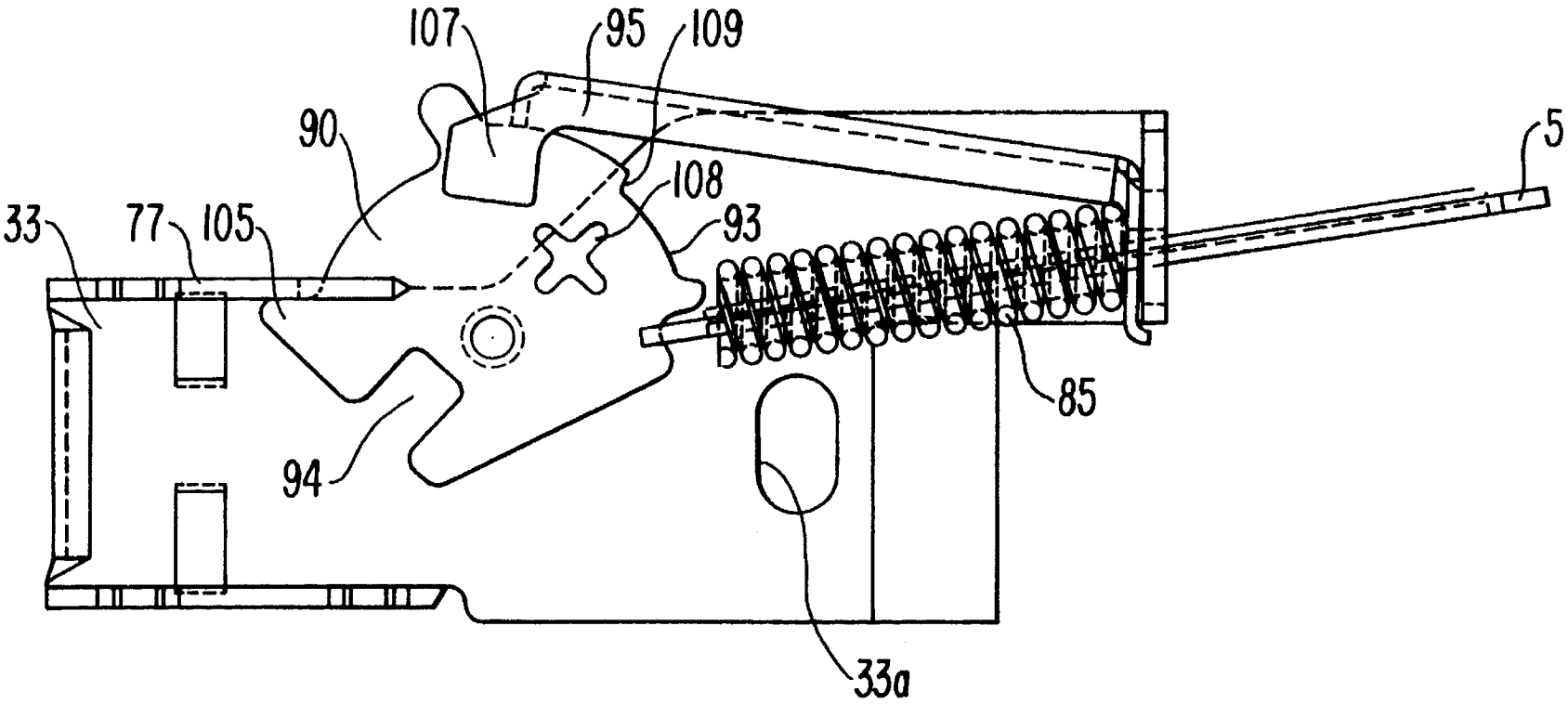
FIGS. 13 to 15 are side views of the securing means according to FIG. 12.
Figure 14:
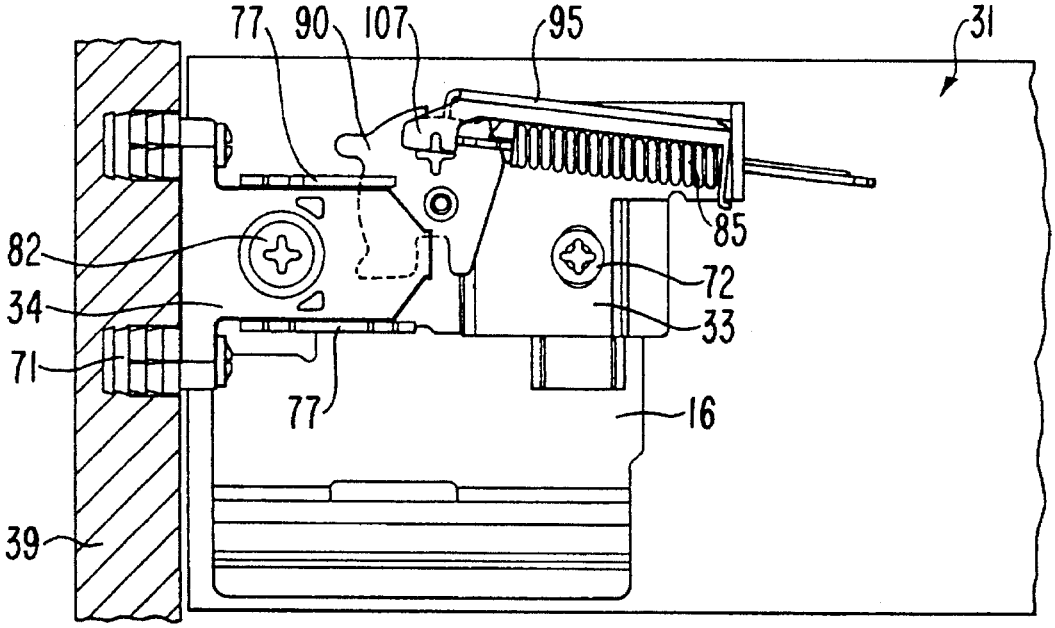
Figure 15:
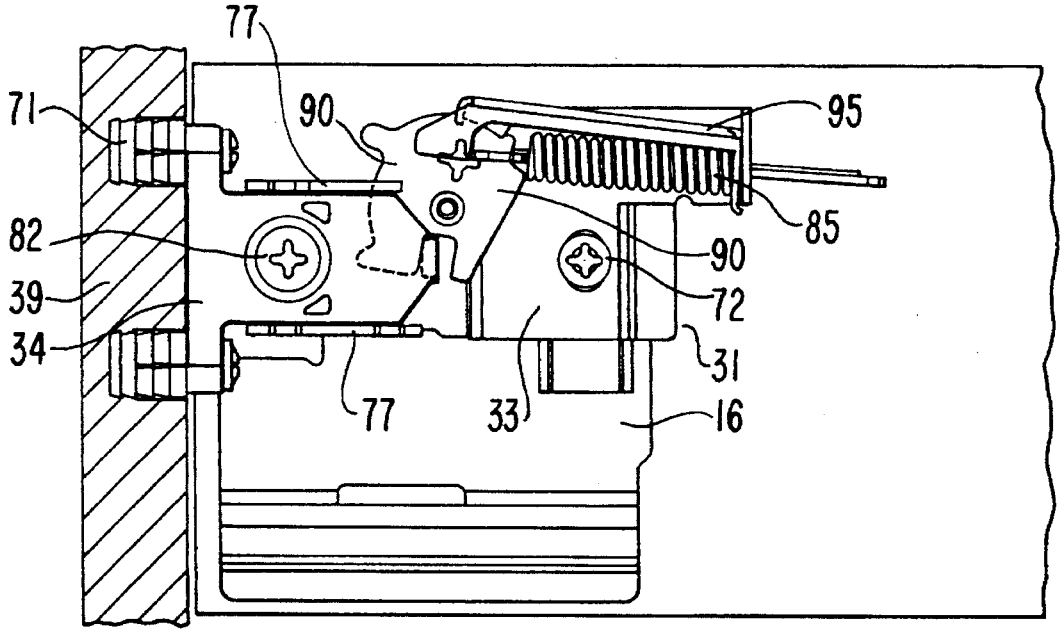

Before the front panel 39 has been pushed onto the drawer frames 28 and the holding parts 34 have been pushed into the support parts 33, the tilt levers 90 are in the position shown in FIG. 13. That is, the spring 85 rotates lever 90 clockwise far enough for a lug 105 to bear against the upper web 77. Once the holding part 34 is pushed into the support part 33, the lug 100 latches into the notch 94 and turns the tilt lever 90 counterclockwise. Once the spring 85 has passed the dead center position, the tilt lever 90 is also turned counterclockwise by the spring 85. Thus, the holding part 34 is pulled into the support part 33 and the front panel 39 is pushed against the drawer frame 28.

The tilt lever 90 is provided with a cross slot 108. The locking bolt 95 has a lateral web 107 which reaches laterally over the tilt lever 90. When the front panel 39 is to be released from the drawer frame 28, a Phillips screwdriver is inserted into the cross slot 108. This raises up the locking bolt 95, since the screwdriver bears against the lateral web 107. At the same time, the locking flange 97 is lifted out of the notch 93 in the tilt lever 90 and the tilt lever 90 is thus freed. The tilt lever 90 can now be turned clockwise, by the Phillips screwdriver projecting into the cross slot, as a result of which the holding part 34 is freed.

If a drawer is pushed into the furniture cabinet too forcefully, a shock absorber effect again occurs. When the front panel 39 strikes against the side walls 36 of the cabinet, the drawer frames 28 and the pull-out rails 15 can be lifted away from the front panel 39, in opposition to the action of the spring 85, to the extent permitted by a spacing between the locking flange 97 and a stop face 109 on the tilt lever 90. Then, the pull-out rails 15 and the drawer frame 28 are pushed against the front panel 39 again by the spring 85.

The holding part 34 can also be connected to a coupling part 103 (FIG. 1) for a front plate. Unlike a front panel 39, an end of which bears against the drawer frames 28, a front plate is located between the two drawer frames 28 and ends at the front thereof. As a result, the front plate does not project beyond the cabinet side walls 36 and the furniture cabinet can be closed using doors.

The rearmost adapter 18 supports, by screws 26, a coupling part 25 for the rear wall 27. The coupling part 25 is provided with pegs 105 which project into punched holes 106 of bent tabs 27*a* of the rear wall 27. Furthermore, the coupling part 25 has a downwardly projecting, preferably resilient hook 108 which hooks into the adapter 18 when the coupling part 25 is mounted. The rear wall 27 is furthermore provided with a lower horizontal web **27*b* on which lies the drawer bottom plate 38**.

We claim:

1. A pull-out guide assembly for use on each of opposite sides of a drawer to guide movement of the drawer into and out of an article of furniture, said assembly comprising:

a support rail to be attached to a furniture side wall;

a pull-out rail to be attached to the drawer;

a central rail between said supporting rail and said pull-out rail;

respective pulleys mounted on front and rear ends of said central rail;

a control cable connectable to one of said pull-out rail and said support rail, said control cable having opposite first and second ends;

a coupling device operable to connect said first and second ends of said control cable with said control cable running on said pulleys, said coupling device comprising a receiving part attached to said first end of said control cable and an inserting part attached to said second end of said control cable and insertable into said receiving part, said receiving part and said inserting part having mutually engageable portions in the form of respective toothed racks, said inserting part being connectable to said receiving part over an engagement region corresponding to lengths of said toothed racks in a direction of insertion of said inserting part into said receiving part; and one of said inserting part and said receiving part being connectable to the other of said pull-out rail and said support rail.

2. An assembly as claimed in claim 1, wherein said one of said inserting part and said receiving part is connectable to said support rail.

3. An assembly as claimed in claim 2, wherein said inserting part is connectable to said support rail.

4. An assembly as claimed in claim 3, wherein said inserting part has a laterally extending hook member that is insertable into a hole in said support rail.

5. An assembly as claimed in claim 4, wherein said hook member has at opposite sides thereof guide pegs that are projectable into said hole.

6. An assembly as claimed in claim 1, wherein said receiving part comprises a housing including walls defining an interior and an opening into said interior, at least one said wall having at an interior surface thereof a respective said toothed rack, and said inserting member comprises a projecting web insertable through said opening into said interior, said web having on at least one surface thereof a respective said toothed rack to engage said toothed rack in said housing.

7. An assembly as claimed in claim 6, wherein two opposed walls of said housing have at respective interior surfaces thereof respective said toothed racks, and said web has on opposite surfaces thereof respective said toothed racks.

8. An assembly as claimed in claim 7, wherein said housing has another two opposed walls having therethrough respective apertures.

9. An assembly as claimed in claim 7, wherein said housing has an insertion end having a U-shaped recess.

10. An assembly as claimed in claim 1, further comprising another coupling device to connect said control cable to said one of said pull-out rail and said support rail.

11. An assembly as claimed in claim 10, wherein said one of said pull-out rail and said support rail comprises said pull-out rail.

12. An assembly as claimed in claim 10, wherein said another coupling device comprises an outer coupling part secured to said one of said pull-out rail and said support rail and an inner coupling part secured to said control cable and insertable into said outer coupling part.

13. An assembly as claimed in claim 12, wherein said inner coupling part has the shape of a cylinder and has a toothed rack.

14. An assembly as claimed in claim 13, wherein said toothed rack of said cylinder comprises teeth extending annularly of said cylinder.

15. An assembly as claimed in claim 13, wherein said cylinder has frustoconical opposite ends.

16. An assembly as claimed in claim 13, wherein said toothed rack of said cylinder is defined by teeth each having a cross-sectional shape in the form of an isosceles triangle.

17. An assembly as claimed in claim 16, wherein each said tooth has a rounded outer edge.

18. An assembly as claimed in claim 12, wherein said outer coupling part has therein a trough-shaped recess into which said inner coupling part can be pushed.

19. An assembly as claimed in claim 18, wherein said inner coupling part is insertable into said trough-shaped recess in a direction transverse to a direction of elongation thereof.

20. An assembly as claimed in claim 18, wherein said outer coupling part has a base having therethrough at least one aperture opening into said trough-shaped recess.

21. An assembly as claimed in claim 12, wherein said trough-shaped recess is at least partially defined by at least one recess.

22. An assembly as claimed in claim 1, further comprising a peg member on said central rail, and a retraction device on one of said support rail and said pull-out rail and including a retainer spring-biased to move longitudinally of said rails and operable at said peg member to urge said central rail to a fully inserted position thereof.

23. A pull-out guide assembly for use on each of opposite sides of a drawer to guide movement of the drawer into and out of an article of furniture, said assembly comprising:

a support rail to be attached to a furniture side wall;

a pull-out rail to be attached to the drawer;

a central rail between said supporting rail and said pull-out rail;

respective pulleys mounted on front and rear ends of said central rail;

a control cable connected to said pull-out rail and to said support rail, said control cable running over said pulleys;

a peg member on said central rail; and a retraction device on one of said support rail and said pull-out rail and including a retainer spring-biased to move longitudinally of said rails and operable at said peg member to urge said central rail to a fully inserted position thereof.

* * * * *